United States Patent [19]

Arakaki

[11] Patent Number: 4,996,903

[45] Date of Patent: Mar. 5, 1991

[54] TWO STAGE GUN

[76] Inventor: Steven Y. Arakaki, 927 Laki Rd., Honolulu, Hi. 96817

[21] Appl. No.: 406,360

[22] Filed: Sep. 12, 1989

[51] Int. Cl.[5] ..... F41B 6/00

[52] U.S. Cl. ..... 89/8; 124/3; 310/12

[58] Field of Search ..... 89/8; 124/3; 310/12

[56] References Cited

U.S. PATENT DOCUMENTS

| | | | |
|---|---|---|---|
| 920,709 | 5/1909 | Alderman | 89/8 |
| 1,301,327 | 4/1919 | Slate | 89/8 |
| 1,384,769 | 7/1921 | MacLaren | 89/8 |
| 1,421,435 | 7/1922 | Faucjon-Villeplee | 89/8 |
| 1,565,895 | 12/1925 | Blaustein | 89/8 |
| 1,959,737 | 5/1934 | Rigsby | 89/8 |
| 1,985,254 | 12/1934 | Huse | 89/8 |
| 2,235,201 | 3/1941 | Cole | 89/8 |
| 2,783,684 | 3/1957 | Yoler | 89/8 |
| 2,870,675 | 1/1959 | Salisbury | 89/8 |
| 3,086,424 | 4/1963 | Liao | 89/8 |
| 3,126,789 | 3/1964 | Meyer | 89/8 |
| 3,431,816 | 3/1969 | Dale | 89/8 |
| 3,985,078 | 10/1976 | Hart et al. | 89/8 |
| 4,343,223 | 8/1982 | Hawke et al. | 89/8 |
| 4,347,463 | 8/1982 | Kemeny et al. | 318/135 |
| 4,429,612 | 2/1984 | Tidman et al. | 318/135 |
| 4,433,607 | 2/1984 | Kemeny | 89/8 |
| 4,434,333 | 2/1984 | Kurherr | 89/8 |
| 4,449,441 | 5/1984 | McAllister | 89/8 |
| 4,480,523 | 11/1984 | Young et al. | 89/8 |
| 4,534,263 | 8/1985 | Heyne et al. | 89/8 |
| 4,555,972 | 12/1985 | Heyne et al. | 89/8 |
| 4,640,180 | 2/1987 | Rose | 89/8 |
| 4,641,567 | 2/1987 | Creedon | 89/8 |
| 4,644,119 | 2/1987 | Wu | 200/144 |
| 4,698,532 | 10/1987 | Ross | 89/8 |
| 4,718,322 | 1/1988 | Honig et al. | 89/8 |
| 4,741,271 | 5/1988 | Delvecchio et al. | 89/8 |
| 4,754,687 | 7/1988 | Kemeny | 89/8 |
| 4,766,336 | 8/1988 | Deis et al. | 89/8 |
| 4,796,511 | 1/1989 | Eyssa | 89/8 |
| 4,813,332 | 3/1989 | Jasper, Jr. | 89/8 |
| 4,817,494 | 4/1989 | Cowan | 89/8 |

*Primary Examiner*—Stephen C. Bentley

*Attorney, Agent, or Firm*—James Creighton Wray

[57] ABSTRACT

The gun has two parts. The first part is an ordinary gun with an ammunition feeder, a chamber and breech and a barrel. The second part has electromagnet assemblies, which includes plural electromagnets serially arranged in gradually reducing spirals. Equal electromagnets are arranged on opposite sides of the bore in two or three or more equally counter rotating cylinders. The electromagnets are sequentially energized beginning when a sensor along the barrel senses the passage of the powder propelled projectile. The reduction in angular twist of the magnets and the increased linear steps near the muzzle uniformly linearly accelerates the projectile through the electromagnetic drivers. Pairs of magnets allows increased number of electromagnets with sufficient space between contacts and magnets. A firing pin is activated at a precise time to deliver the accelerating projectile to the accelerated by the first electromagnets as the rotating assemblies position the first magnets along the gun.

20 Claims, 5 Drawing Sheets

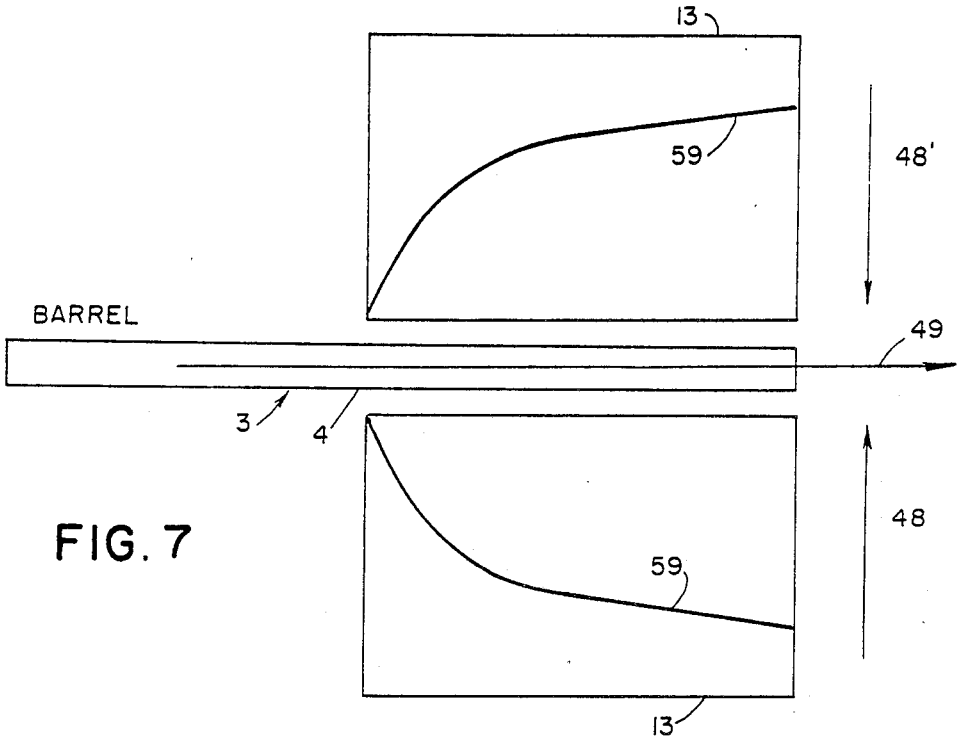
FIG. 7
FIG. 8
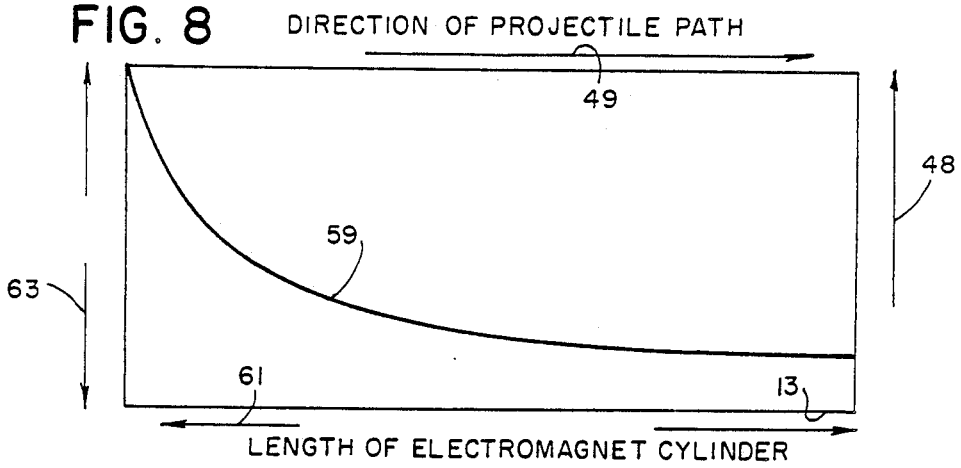
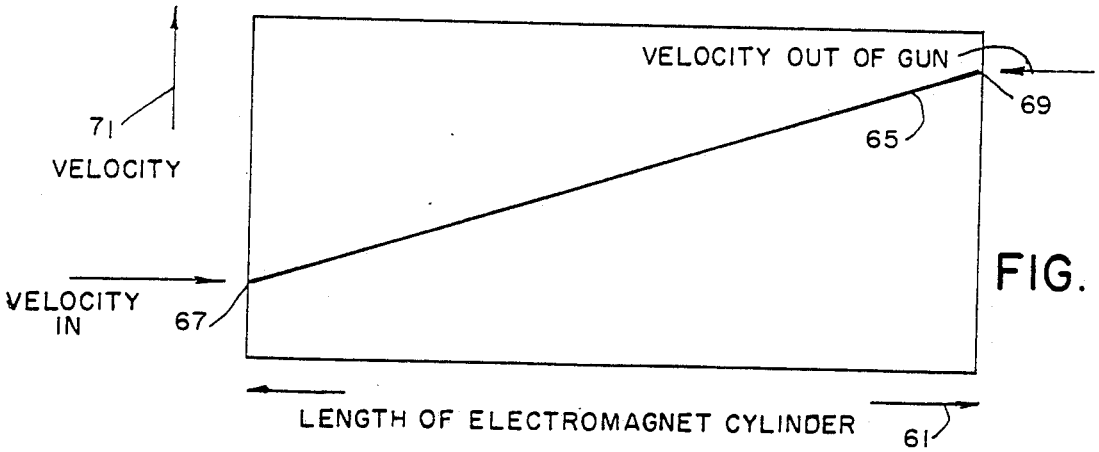
FIG. 9

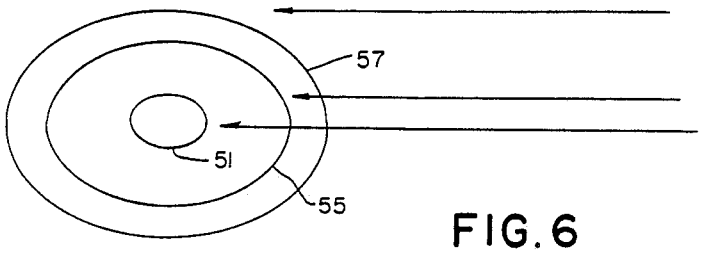
FIG. 6
FIG. 4
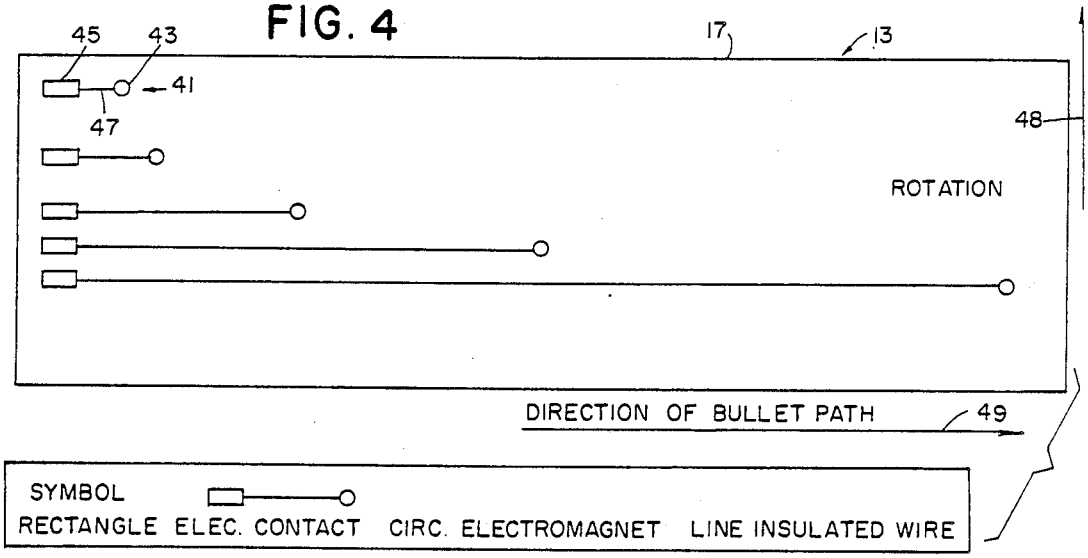
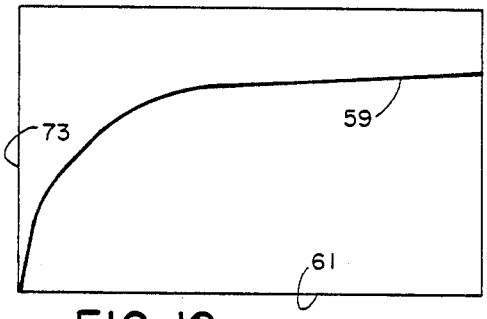
FIG. 10
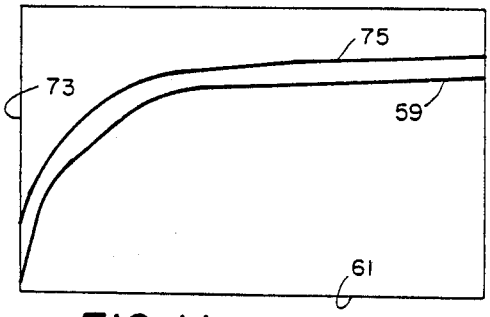
FIG. 11
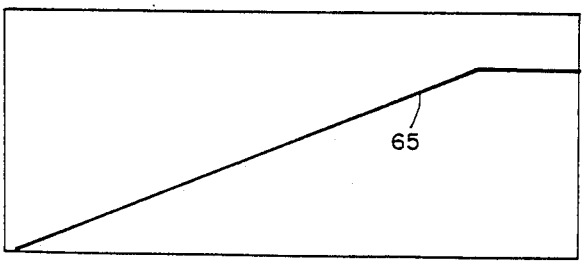
FIG. 12

FIG. 15
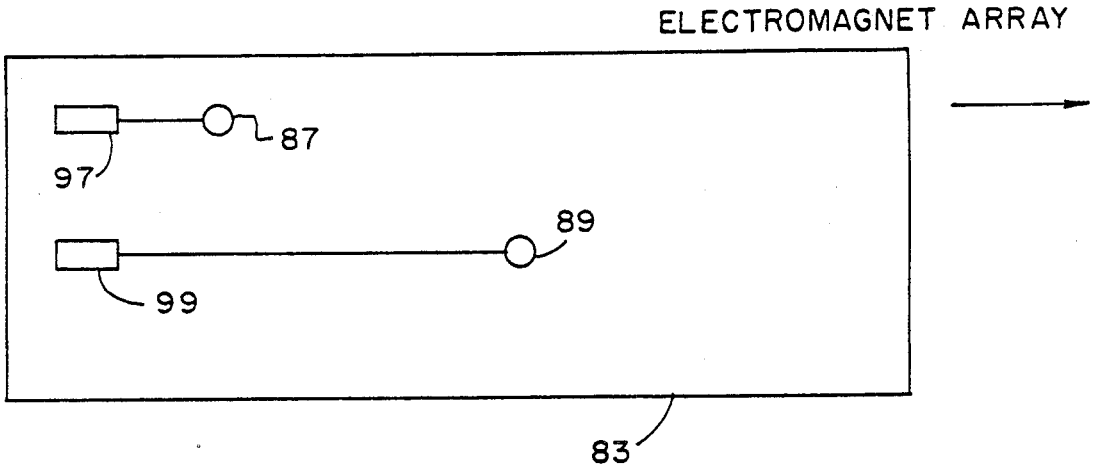
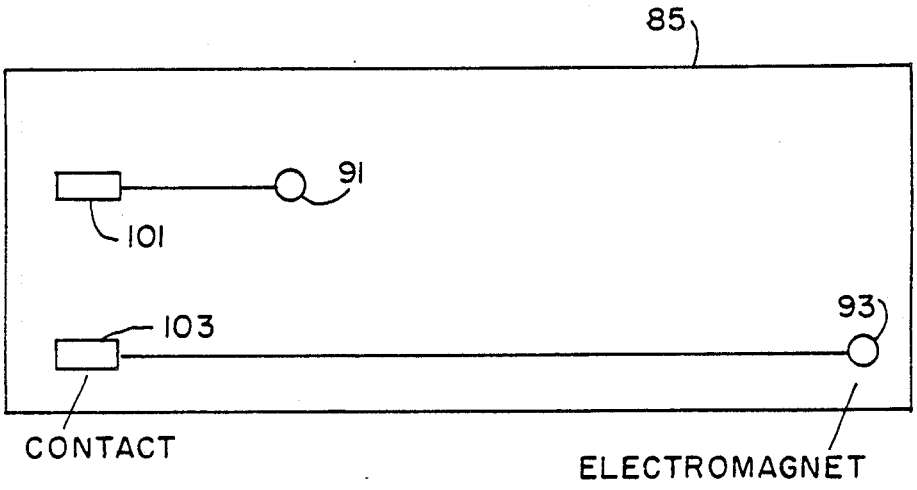
FIG. 16

TWO STAGE GUN

BACKGROUND OF THE INVENTION

Several patents describe the use of magnetic acceleration rails to drive projectiles. Many of those patents sequence the switching along with rails to drive the projectile between the rails. Some of the rails are open, some are closed in a cylinder.

Westinghouse U.S. Pat. No. 4,555,972 describes a projectile which is spun by rifling grooves as it is propelled through a bore with a conventional powder charge. Upon reaching the end of the bore, the projectile is accelerated with magnetic energy along conductive rails.

U.S. Pat. No. 2,870,675 describes sequential magnetic energization for acceleration of a projectile. Uniquely, the generator is another projectile. U.S. Pat. No. 4,343,223 describes sequential operations of a magnetic rail gun accelerator.

A need exists for patents which accelerate projectiles from magnetic drives with greater energies and efficiencies.

SUMMARY OF THE INVENTION

The present gun consists of two parts. One section resembles a conventional gun, while the second section is an electromagnetic driver. By combining the two together a gun with the ability to fire a round at high velocities is formed.

To fire a round, the first section fires a steel projectile by conventional means; an explosive substance is used. As the projectile travels down the barrel of the gun, it passes by the electromagnet drivers. The electromagnet drivers create a linearly accelerating magnetic field ahead of the projectile. Each electromagnet driver establishes a magnetic field that pulls on the projectile for a fraction of a second. The series of pulls causes the projectile to accelerate. By the time the projectile leaves the barrel, the velocity has increased substantially.

The invention provides energy savings. By not relying totally on the use of a magnetic field to drive the projectile the electrical energy requirements to propel a round to hypersonic velocity are reduced.

The invention provides advantages in size. The length of the gun is reduced by arranging the electromagnets in a spiral. The spiral allows a greater number of electromagnets to be fitted along the length of the gun barrel.

The gun has a two-piece smooth bore barrel. One section in which the round is chambered is made out of a strong alloy steel. The remaining section is made out of a nonmagnetic material so that the magnetic field can act on the projectile without distorting the field by the barrel. The gun has a round feeding and shell casing extracting system for the ammunition. The gun preferably uses a solid propellent round with a fin stabilized projectile. The projectile is designed to be attracted to the magnetic field, and is also designed to relay on fins to stabilize it through its flight through the air.

The second part of the gun barrel has paired electromagnet arrays on individual cylindrical structures. A pair of electric/air powered motors and transmissions drive the electromagnet arrays. A single motor can be used to drive both arrays. The drive includes an electrical power source. Individual electromagnets and electrical contacts are inserted into the electromagnet arrays.

In one form of the invention opposite cylindrical arrays may be used on opposite sides of the barrel. In another embodiment, cylindrical arrays may be grouped in three, each spaced 120 degrees around the barrel. In another embodiment, the cylindrical arrays may be arranged in groups divisible by two or three so that magnets on opposite sides of the barrel 180 degrees or 120 degrees apart may work in unison to pull and accelerate the projectile.

A computer determines the precise time to fire a round and makes adjustments to the rotational speed of the electromagnet arrays. Sensors detect the rotational speed of the electromagnet arrays, and position the first electromagnets. The timing between the electromagnets and the firing of the gun is matched. Before a round is fired, a computer checks to be sure that the electromagnet assemblies are at the right rotational speed and positions. The electromagnets must be in the right position so that, as the projectile passes through the electromagnetic driver section of the gun, each individual electromagnet is turned on and turned off at precisely the right moment.

The ideal time for each electromagnet to turn on is when the projectile approaches near it. As the body of the projectile gets nearer to the electromagnet, that electromagnet is turned off. The next electromagnet that is ahead of the projectile is then turned on and is turned off when the projectile body closes in on it. The sequence of turning on the individual electromagnets that are ahead of the tip of the projectile, and turning off the electromagnets as the projectile body closes in on the electromagnets continues until the projectile leaves the barrel of the gun.

In a preferred embodiment the electromagnets are arranged in a spiral on two cylindrical rotating assemblies. The two assemblies are mirror images of each other. Each cylindrical assembly is encased in an individual housing, each assembly is driven by a separate transmission and motor. The assemblies rotate in opposite directions.

On each assembly in a preferred embodiment there is a sensor which relays back to the computer the speed which each assembly is running, and the position of the first electromagnet on each assembly. This insures that both assemblies are in synchronization with each other. If one is lagging behind, the computer speeds it up, and interrupts any firing of the gun until both assemblies are in synchronization with each other.

An alternative to monitoring each assembly is to have both of them connected by one transmission and powered by one motor. This way both assemblies are locked together physically through the transmission, and only one assembly needs to be monitored. As the gears wear out the assemblies may lose precise synchronization with each other.

In a preferred embodiment of electromagnetic array housings, each housing is positioned along side the barrel. In that way the magnetic fields generated by the electromagnets are as close as possible to the projectiles. The housings preferably are parallel with the barrel. Any offset may result in the magnetic field pulling the projectile towards a side of the barrel.

In a preferred embodiment, the bodies of the array are balanced so that vibrations will not occur. The magnitude of the vibrations would increase as the rotation speed of the arrays increases. The result might be catastrophic if the arrays aren't balanced.

Providing power to the electromagnets is done by connecting one end of each electrical lead to each electromagnet to the body of the array. The other lead is connected to contacts at the end of the array. The contacts are insulated against the body of the array. Each contact is for one electromagnet. All the contacts are placed so that they encircle the array. When power is turned on each electromagnet will be turned on and off in sequence by means of a single power electrode making contact with each insulated contact, as the array rotates the contacts.

In preferred embodiments, electromagnets are constructed by winding wires numerous times about a ferrous core. Application of an electric current through the wires creates magnetic fields. That is the general way the electromagnets are made; there are numerous ways the ferrous core can be configured. Different designs in the ferrous core will determine whether or not there will be a need for an external fastening device. If threaded, the core can be attached directly to the structure. If it is not threaded then the core must be fastened to the structure by other means.

In one embodiment of the invention, four magnetic assemblies are arranged in two pairs of two. The pairs are spaced 90 degrees from each other. The assemblies in each pair are spaced 180 degrees around the barrel, directly opposite each other. The use of four assemblies allows greater room for mounting the magnets and contacts and greater spacing therebetween and allows more magnets to be used. When six arrays are used, for example, the arrays may be grouped in three pairs or two groups of three. Although four arrays is sufficient, the arrays could be grouped in pair of triplets totalling 3, 4, 6, 8, 9, 10, 12, 14, 15, etc.

There are two electrical connections to each electromagnet. For the sake of simplifying the electrical layout of the wiring, one connection is made to a common conductor in the structure. The structure is electrically connected to the power source. The other connection is made to the contact electrode. Energizing the electromagnet power is applied through the electrode.

These and other and further objects and features of the invention are apparent form the disclosure which includes the above and ongoing specifications, with the claims, and the drawings.

BRIEF DESCRIPTION OF THE DRAWINGS

FIG. 4 is a front developed view of an electromagnet assembly for mounting adjacent a gun barrel of the present invention.

FIG. 6 is a schematic axial view of the electromagnet assembly shown in FIG. 6.

FIG. 7 is a schematic view showing flattened developed electromagnet assemblies next to a gun barrel.

FIG. 8 is is a schematic graphical view of positions of electromagnets along the surface of an electromagnet assembly.

FIG. 9 is a graphic representation of projectile acceleration.

FIG. 10 is a graphic comparison of an angular electromagnet positions.

FIG. 11 is a graphic representation of angular electromagnet positions and projectile positions.

FIG. 12 is a graphic comparison of rotary position and velocity.

FIGS. 15 and 16 shows electromagnetic spacing on schematic elevations of opposite arrays shown in FIG. 15.

DETAILED DESCRIPTION OF THE DRAWINGS

Figure 1:
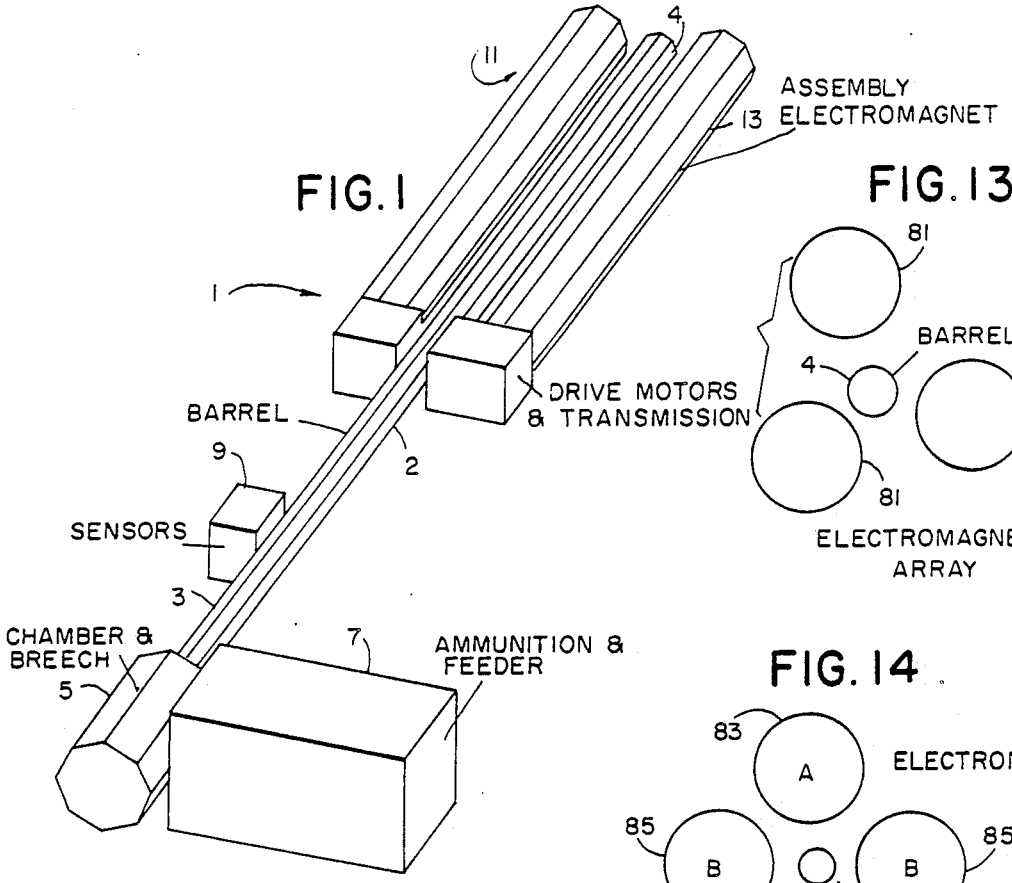
FIG. 1 is a block diagram of a gun of the present invention.

Referring to FIG. 1, a gun generally indicated by the numeral 1 has an elongated gun barrel 3, a chamber and breech assembly 5 and an ammunition feeder 7. A sensor 9 senses projectiles through the first linear portion 2 of the gun barrel before the projectile enters the second portion 4 of the gun barrel. Electromagnet assemblies generally indicated by the numeral 11 are mounted along the second portion 4 of the gun barrel. The electromagnet assemblies 11 include rotatable cylindrical electromagnet carriers 13 and drive motors 15 for rotating the carriers.

Figure 2:
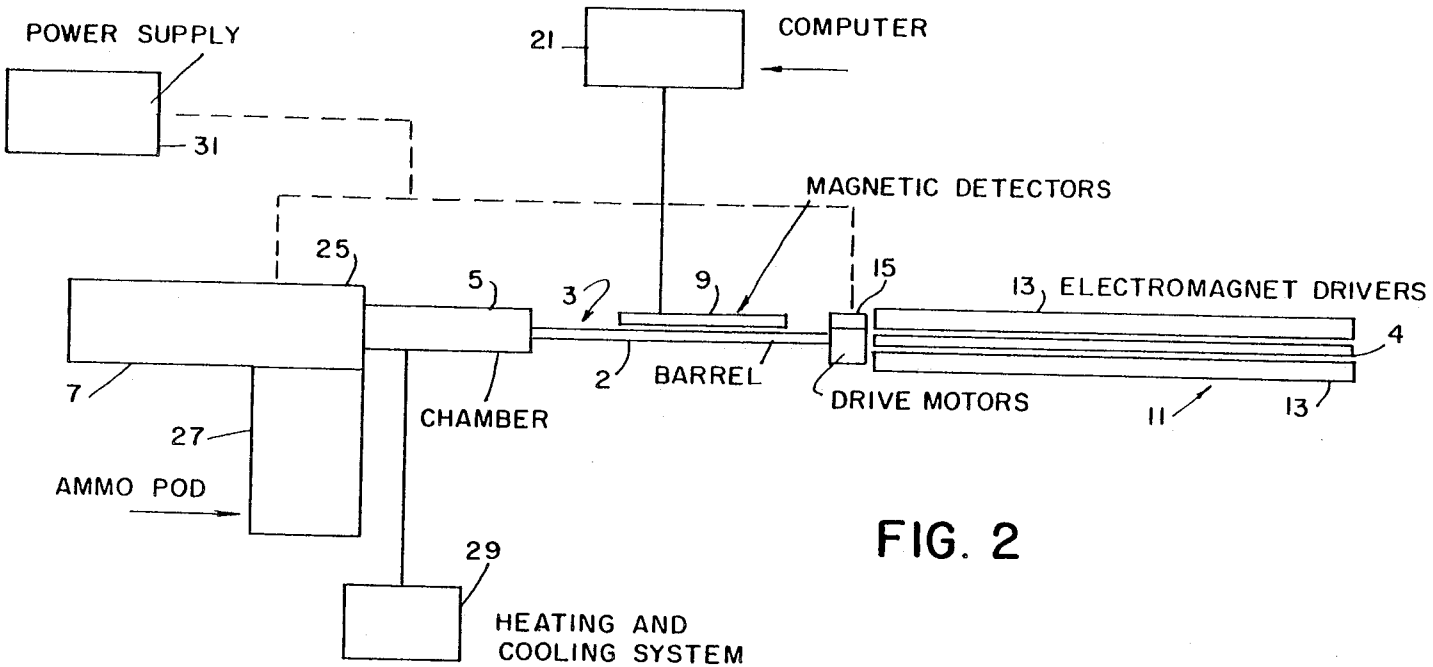
FIG. 2 is a side elevational schematic representation of a gun of the present invention.

As shown in FIG. 2 a computer 21 is connected to the sensors 9 which are plural magnetic detectors arranged along the first portion 2 of the gun barrel 3. The computer 21 is connected to the drive motors 15 or to the electromagnetic carrier 13 to determine angular position of the carriers and electromagnets. The chamber breech assembly 5 includes a breech block assembly 25 with a firing pin. The computer 21 is also connected to the firing pin assembly for permitting firing of a projectile only upon correct contact position of the electromagnets. The ammunition feeder 7 includes an extractor and feeder and ammunition pod 27. A heating and cooling system 29 is connected to the chamber 5.

Preferably the assemblies 11 begin to turn when a gun is readied for firing. The assemblies continuously turn preserving angular momentum. The firing pin is enabled by the computer at precisely the correct timing to ensure that the first set of electromagnets will be precisely positioned for the approaching projectile. Rapid fire is limited only by the quickness of actions of the loader and breech block. As soon as the block closes, the firing pin is enabled as the magnets approach the first position.

A power supply 31 supplies power to the breech and firing pin assembly 25 and to the ammunition feeder and shell casing extractor 7 and the ammunition pod 27. The power supply 31 also supplies power to the drive motors 15 to turn the electromagnet carriers 13 in the electromagnetic assemblies 11.

Figure 3:
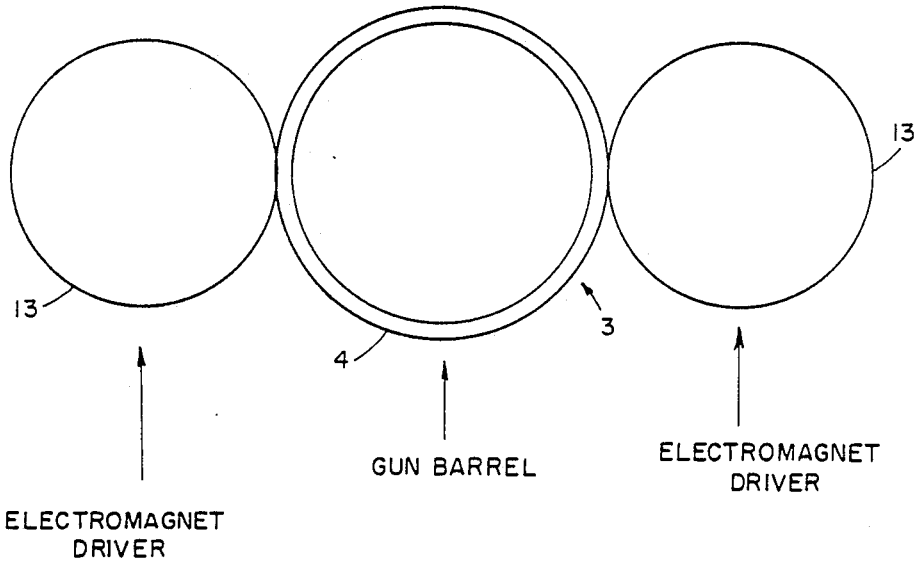
FIG. 3 is an axial schematic representation of the gun of the present invention.

It is shown in FIG. 3 the forward portion 4 of the gun barrel 3 is mounted between the electromagnetic carriers 13. The electromagnetic carriers 13 which were also called electromagnetic drivers are positioned on each side of the barrel. Structural elements which support the barrel and drivers are not shown. It is important that the drivers be as close as possible to the barrel so that the magnetic field is as close as possible to the projectile. The material of the barrel must not distort the magnetic fields.

As shown in FIG. 4, the developed view of the electromagnetic carrier 13 shows the cylindrical surface 17 which has been flattened. Each magnetic driver 431 includes an electromagnet 43, an electrical contact 45 and a conductor 47 connecting the contact 45 with the electromagnet 43.

In FIG. 4, the rectangular blocks represent electrical contacts; the circles represent electromagnets, and the lines are insulated wires. The cylindrical surface 17 of the carrier, or mount 3 is shown flattened or developed. Arrow 48 represents the rotational direction of the carrier 13, and arrow 49 represents the direction of the projectile path.

Figure 5:
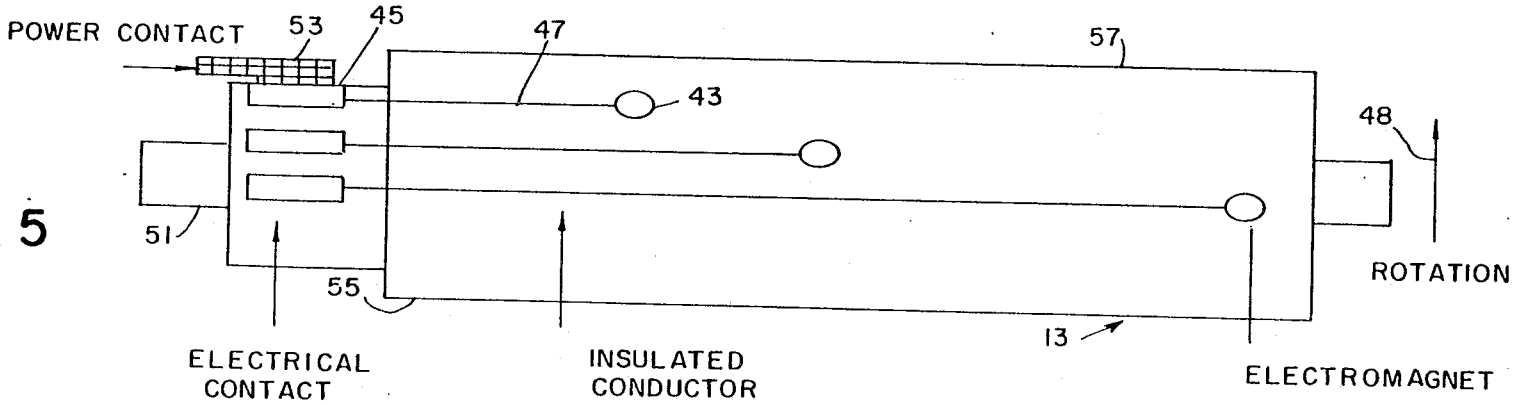
FIG. 5 is a detail of an electromagnet assembly for mounting adjacent the gun barrel.

In FIG. 5, the elements of FIG. 4 are shown mounted on a rotational axis 51. A power contactor 53 conducts electricity to the contacts 45 which are arranged on the cylindrical portion 55. The electromagnets 43 and insulated conductors 47 are positioned in the rotating carrier 13. The structural supports, mechanical drawings and transmissions and power lines to the power contact 53 are not shown. The drawing illustrates the basic layout. Other electromagnets conductors and contacts may be arranged so that the magnets are along the same curved line. When power connection is made to the structure of the carrier 13, the other connection is made through the insulated conductor 47 and the power contact 45 through the power contact 53. Arrow 47 indicates the direction of rotation of the carrier 13.

As shown in FIG. 6 a front view of the carrier 13 schematically shows the axle 51, the surface 55 on which the electrical contacts are mounted and the outer surface 57 in which electromagnets are mounted.

As shown in FIG. 7, the gun barrel 3 has an elongated forward portion 4 along which electromagnet carriers 13 are graphically represented. Lines 59 on the graph depict the positions of the electromagnets on the developed cylinders. The cylinders are counter-rotated to each other in the directions shown by arrows 48 and 48', bringing successive magnets near the barrel as the projectile travels in the direction of arrow 49. In FIG. 7, the cylinders containing the electromagnets are laid out flat so that electromagnet positions as the cylinders rotate in relation to each other can be seen. Each cylinder rotates opposite to the other.

FIG. 8 shows a graphical relation of the length 61 of the electromagnet carrier and as compared to the circumference 63 as well as a line connections centers of the positions 59 of the electromagnets to the surface. FIG. 9 shows the velocity 65 of the projectile along portions of the gun by the electromagnet cylinder 13. The velocity accelerates uniformly from the starting position 67 to the terminal position 69. The length of the electromagnet carrier cylinder is represented by the arrow 61 and increasing velocity is represented by the arrow 71.

FIG. 10 shows a electromagnet positions 59 as compared with the length 61 of the cylinder and the rotational position 73 from 0° to 360°.

FIG. 11 compares the positions 59 of the electromagnets and the projectile position 75. The graph shows how the projectile lags behind the electromagnets along the length of the barrel. That happens because the electromagnets are designed to pull the projectile.

FIG. 12 shows a relationship of the velocity 65 to the angular rotational degrees of the carrier and the length of the cylinder. The graph of FIG. 12 shows how the velocity of the projectile increases along the length of the barrel with respect to rotor position. When the projectile reaches the end of the barrel the velocity levels off to a contact velocity. The velocity no longer increases because there is no force accelerating the projectile. As the projectile leaves the barrel, velocity begins to decrease because of air resistance.

Figure 13:
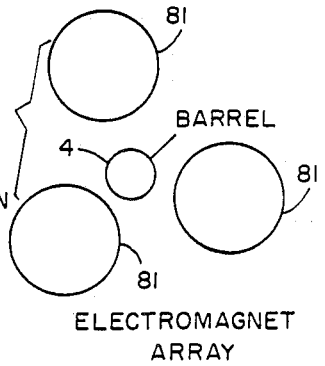
FIG. 13 is a schematic end view representation of three arrays.

FIG. 13 is a schematic end view of three arrays grouped around a gun barrel. The arrays turn in the same direction of rotation and magnets and contacts are identically positioned on each of the cylindrical arrays 81. Three magnets are energized concurrently to pull the projectile along the second stage 4 of the gun barrel.

Figure 14:
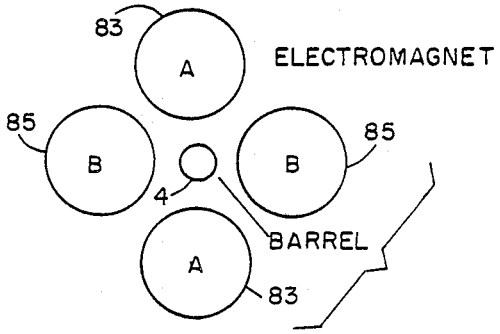
FIG. 14 is a schematic end view representation of four arrays.

FIG. 14 shows an end view of four arrays grouped in pairs of two. The A arrays 83 have magnets and contacts arranged as mirror images and turn in opposite directions. The B arrays 85 have magnets and contacts similar to each other, but arranged as mirror images for opposite turnings of the arrays. The magnets 87 and 89 in the A arrays are stepped axially between the magnets 91 and 93 in the B arrays as shown in FIGS. 15 and 16. The respective contacts 97 and 99 in the A are stepped between contacts 101 and 103 in the B arrays so that paired magnets on opposite sides fire together in the sequences 87, 91, 89, 93, etc., as contacts 97, 101, 99, 103, etc. are energized.

While the invention has been described with reference to the specific embodiments, variations and modifications of the invention may be constructed without departing from the scope of the invention, which is set forth in the following claims.

I claim:

1. A gun for propelling a projectile comprising a barrel having first and second portions, a chamber and breech connected to the first portion of the barrel for propelling and accelerating a projectile through a first portion of the barrel and having electromagnet assemblies along a second portion of the barrel for accelerating the projectile through the second portion of the barrel, the electromagnet assemblies comprising cylindrical electromagnet mounts on opposite sides of the barrel, drive motors, one motor connected to each mount for rotating the mounts adjacent the barrel and a plurality of electromagnets connected to the mounts.

2. The gun as claimed in claim 1 wherein the electromagnets are mounted in the mounts along lines having a varied pitch from near the first barrel portion to near a remote end of the second barrel portion.

3. The gun of claim 1 wherein the electromagnets have conductors extending axially from the magnets in the direction of the breech and terminating in electrical contacts circumferentially arranged as a commutator and having an electrical contactor positioned for contacting the contacts as the cylinder turns for providing electrical power sequentially to the electromagnets.

4. The gun of claim 1 wherein the chamber and breech comprise a shell casing extractor and firing pin and wherein the feeder further comprises an ammunition pod.

5. The gun of claim 1 further comprising a temperature control system connected to the chamber for controlling temperature of the chamber.

6. The gun of claim 1 further comprising a firing pin connected to the chamber and breech and a control means connected to the electromagnet assemblies and to the firing pin for enabling the firing pin upon predetermined angular positions of the electromagnet assemblies.

7. A projectile firing gun having a non-magnetic projectile guide and an electromagnet assembly adjacent the gun, the electromagnet assembly comprising a rotatable cylinder axially parallel to the guide and a drive motor for rotating the cylinder, plural electromagnets arranged in a predetermined pattern in the cylinder for sequentially positioning adjacent the guide as the cylinder rotates adjacent the guide, and activating means for sequentially activating the electromagnets as they are positioned adjacent the guide.

8. The gun of claim 7 wherein the electromagnet assembly comprising first and second electromagnet assemblies on opposite sides of the guide, and wherein the drive motor comprises means for rotating the first and second assemblies in opposite directions and wherein plural electromagnets are positioned on each assembly for positioning predetermined electromagnets in sequentially increasing steps along the guide for accelerating a projectile through the guide.

9. The gun of claim 8 further comprising first and second drive motors connected to the first and second electromagnet assemblies and coordinating means connected to the drive motors for coordinating rotational position and speed of the electromagnet assemblies.

10. The gun of claim 7 further comprising sensors mounted near the guide and a computer connected to the sensors.

11. The gun of claim 7 further comprising a first gun barrel portion connected to the guide and a chamber connected to the first gun barrel portion remote from the guide, a breech, extractor, feeder and firing pin assembly connected to the chamber and an ammunition pod connected to the extractor and feeder for placing a round in the chamber and firing a round and driving a projectile with an explosive charge through the barrel into the guide and accelerating the projectile through the guide with the electromagnet assemblies and further comprising a computer connected to the electromagnet assemblies and to the firing pin for enabling the firing pin to fire the explosive charge in the round when the electromagnets in the assemblies are appropriately aligned with the guide.

12. The gun of claim 7 further comprising multiple cylinders arranged parallel to the guide and rotated by drive motors adjacent the guide and plural electromagnets arranged in paired patterns on separated cylinders.

13. The gun of claim 12 wherein the cylinders are arranged in an equidistantly spaced group of three identical cylinders and electromagnets.

14. The gun of claim 12 wherein the cylinders are arranged in groups of paired opposite cylinders with stepped relationship of electromagnets and contacts in adjacent cylinders.

15. The method of accelerating a projectile through a guide with electromagnet drivers comprising rotating electromagnet assemblies adjacent the guide and sequentially positioning electromagnets in increasing longitudinal steps along the guide, sequentially energizing the electromagnets positioned along the guide and driving and accelerating the projectile through the guide with the electromagnets.

16. The method of claim 15 further comprising introducing a projectile into the guide as initial electromagnets are aligned with the guide.

17. The method of claim 16 further comprising positioning similar electromagnets on opposite sides of the guide in sequential steps.

18. The method of claim 17 wherein the positioning comprising counter-rotating electromagnet assemblies holding the electromagnets on opposite sides of the guide.

19. The method of claim 15 wherein the rotating comprises rotating multiple paired groups of electromagnetic assemblies adjacent the guide and sequentially energizing first electromagnets in the first pair, the first electromagnets in a second pair, the second electromagnets in the first pair and sequentially energizing magnets in adjacent pairs until a projectile leaves the guide.

20. The method of claim 15 wherein the rotating comprises rotating three equally spaced assemblies and wherein the sequentially positioning and energizing comprise concurrently positioning electromagnets in each assembly by the guide and concurrently energizing electromagnets in the three assemblies.

* * * * *